US005461728A

United States Patent [19]

Staszak

[11] Patent Number: 5,461,728

[45] Date of Patent: Oct. 31, 1995

[54] HAND WARMING MUFF AND HOLDING APPARATUS

[76] Inventor: Jeffery G. Staszak, 938 Howard St., Green Bay, Wis. 54303

[21] Appl. No.: 375,584

[22] Filed: Jan. 19, 1995

[51] Int. Cl.[6] ..... A41D 27/20; A41D 13/10; A41D 19/01

[52] U.S. Cl. ..... 2/247; 2/158; 2/161.5; 2/66; 224/240; 224/222

[58] Field of Search ..... 224/148, 240, 224/224, 222; 2/247, 158, 159, 94, 208, 91, 66

[56] References Cited

U.S. PATENT DOCUMENTS 2,751,952 6/1956 Mirus ..... 2/66 X
4,495,659 1/1985 Madnick et al. ..... 2/66
4,625,340 12/1986 Hernandez ..... 2/247
4,893,357 1/1990 Evans ..... 2/208

*Primary Examiner*—C. D. Crowder
*Assistant Examiner*—Shirra L. Jenkins

[57] ABSTRACT

A hand warming muff and holding apparatus for use by a bow hunter including a hip pocket having a tubular insulated body with a sealed bottom end and an open top end, a cuff coupled to the top end of the body for receiving a bow hunter's hand and snugly fitting about the bow hunter's arm once his hand is disposed within the body, and an exterior pocket affixed to body for holding hunting-related accessories therein; and a coupling mechanism for removably securing the hip pocket for use at a location proximal with a bow hunter's waist.

8 Claims, 4 Drawing Sheets

HAND WARMING MUFF AND HOLDING APPARATUS

BACKGROUND OF THE INVENTION

1. Field of the Invention

The present invention relates to a hand warming muff and holding apparatus and more particularly pertains to allowing a bow hunter to keep his hand warm during hunting and for simultaneously carrying hunting-related accessories with a hand warming muff and holding apparatus.

2. Description of the Prior Art

The use of warming muffs is known in the prior art. More specifically, warming muffs heretofore devised and utilized for the purpose of warming a hunter's hand are known to consist basically of familiar, expected and obvious structural configurations, notwithstanding the myriad of designs encompassed by the crowded prior art which have been developed for the fulfillment of countless objectives and requirements.

By way of example, U.S. Pat. No. 3,217,335 to Bell discloses a garment with combined pocket and waist suppressor. U.S. Pat. No. 3,378,852 to Harter discloses a sweater. U.S. Pat. No. 4,275,468 to Outlaw discloses a winter jersey with hand warmer. U.S. Pat. No. 4,408,355 to Brock discloses a hand warmer. U.S. Pat. No. 4,495,659 to Madnick et al. discloses a cold-weather muff. U.S. Pat. No. 4,893,357 to Evans discloses a reversible hand warming muff.

While these devices fulfill their respective, particular objective and requirements, the aforementioned patents do not describe a hand warming muff and holding apparatus that allows a bow hunter to easily warm his hand and also allows bow-hunting related accessories to be carried at a location for ready use.

In this respect, the hand warming muff and holding apparatus according to the present invention substantially departs from the conventional concepts and designs of the prior art, and in doing so provides an apparatus primarily developed for the purpose of allowing a bow hunter to keep his hand warm during hunting and for simultaneously carrying hunting-related accessories.

Therefore, it can be appreciated that there exists a continuing need for new and improved hand warming muff and holding apparatus which can be used for allowing a bow hunter to keep his hand warm during hunting and for simultaneously carrying hunting-related accessories. In this regard, the present invention substantially fulfills this need.

SUMMARY OF THE INVENTION

In the view of the foregoing disadvantages inherent in the known types of warming muffs now present in the prior art, the present invention provides an improved hand warming muff and holding apparatus. As such, the general purpose of the present invention, which will be described subsequently in greater detail, is to provide a new and improved hand warming muff and holding apparatus and method which has all the advantages of the prior art and none of the disadvantages.

To attain this, the present invention essentially comprises, in combination, a hip pocket. The hip pocket includes a tubular body formed of an outer fabric layer and an inner fabric layer with an intermediate insulated layer disposed therebetween. The body has a sealed bottom end, an open top end, and an axial length about 33% greater than its diameter. The hip pocket further includes an elastic ribbed fabric cuff for receiving a bow hunter's hand. The cuff has a conical hollow lower extent coupled to the top end of the body and a tubular upper extent for snugly fitting about the bow hunter's arm once his hand is disposed within the body. The hip pocket additionally includes a generally rectangular exterior pocket with an upwardly extended opening. The exterior pocket is affixed to the outer layer of the body and is used for holding hunting-related accessories therein. The exterior pocket has a strip of pile-type fastener coupled thereto, a flap affixed to the body and positionable over the opening, and a strip of complimentary pile-type fastener affixed to the flap and removably securable with the pile-type fastener to seal the opening.

A leather belt loop is included and affixed to the top end of the body of the hip pocket. The belt loop is sized for receiving a belt of a bow hunter and thus allowing the hip pocket to be carried at a location proximal with the bow hunter's waist. Lastly, a leg strap is included and formed of a fabric material. The leg strap has a first free end with a pile-type fastener secured thereto, a second free end with a complimentary pile-type fastener secured thereto, and an intermediate portion between the ends affixed to the body near the bottom end thereof. The fasteners of the leg strap are removably securable in a closed loop configuration about a leg of a bow hunter to prevent unmoderated movement of the hip pocket.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved hand warming muff and holding apparatus which has all the advantages of the prior art warming muffs and none of the disadvantages.

It is another object of the present invention to provide a new and improved hand warming muff and holding apparatus which may be easily and efficiently manufactured and marketed.

It is a further object of the present invention to provide a new and improved hand warming muff and holding apparatus which is of durable and reliable construction.

An even further object of the present invention is to provide a new and improved hand warming muff and holding apparatus which is susceptible of a low cost of manufacture with regard to both materials and labor, and which accordingly is then susceptible of low prices of sale to the consuming public, thereby making such a hand warming muff and holding apparatus economically available to the buying public.

Still yet another object of the present invention is to provide a new and improved hand warming muff and holding apparatus which provides in the apparatuses and methods of the prior art some of the advantages thereof, while simultaneously overcoming some of the disadvantages normally associated therewith.

Even still another object of the present invention is to provide a new and improved hand warming muff and holding apparatus for allowing a bow hunter to keep his hand warm during hunting and for simultaneously carrying hunting-related accessories.

Lastly, it is an object of the present invention to provide a new and improved hand warming muff and holding apparatus comprising a hip pocket including a tubular insulated body having a sealed bottom end and an open top end, a cuff coupled to the top end of the body for receiving a bow hunter's hand and snugly fitting about the bow hunter's arm once his hand is disposed within the body, and an exterior pocket affixed to body for holding hunting-related accessories therein; and a coupling mechanism for removably securing the hip pocket for use at a location proximal with a bow hunter's waist.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
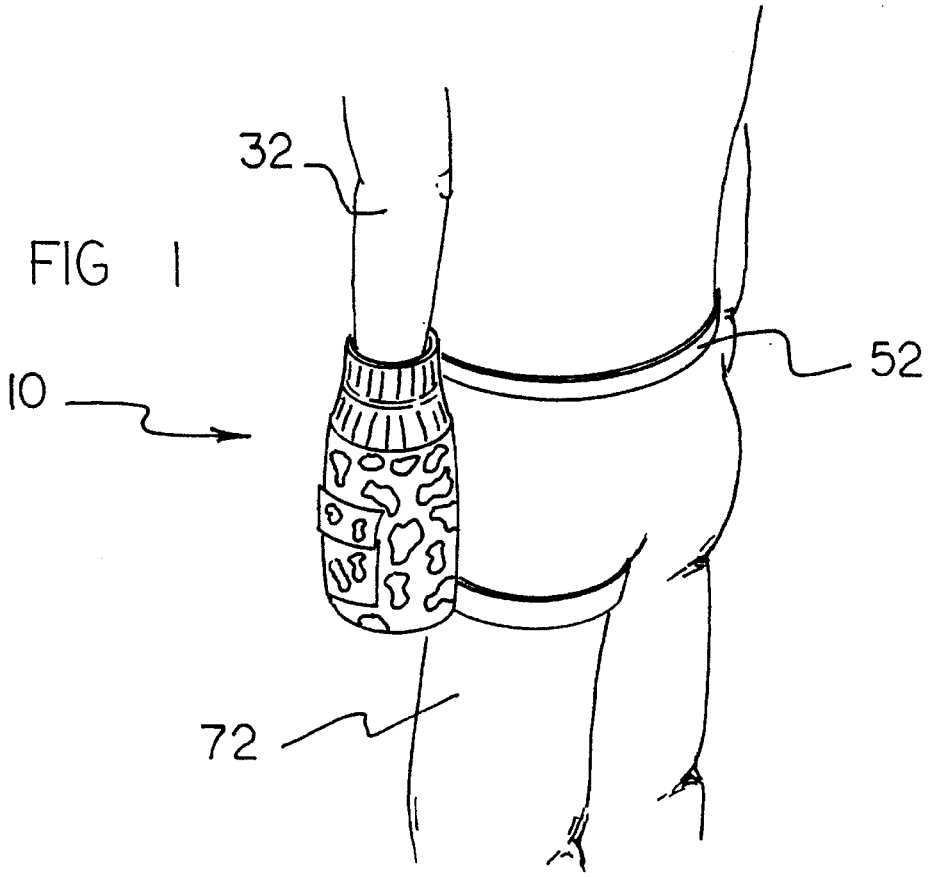
FIG. 1 is a perspective view of the preferred embodiment constructed in accordance with the principles of the present invention secured to a bow hunter for use.

With reference now to the drawings, and in particular, to FIG. 1 thereof, the preferred embodiment of the new and improved hand warming muff and holding apparatus embodying the principles and concepts of the present invention and generally designated by the reference number 10 will be described.

The present invention is comprised of a plurality of components. In their broadest context, such components include a hip pocket and a human-securable coupling mechanism. Such components are individually configured and correlated with respect to each other to provide the intended functions of allowing a bow hunter or other user to keep his hand warm while hunting and simultaneously allow hunting-related accessories to be carried at a location for ready access.

Figure 2:
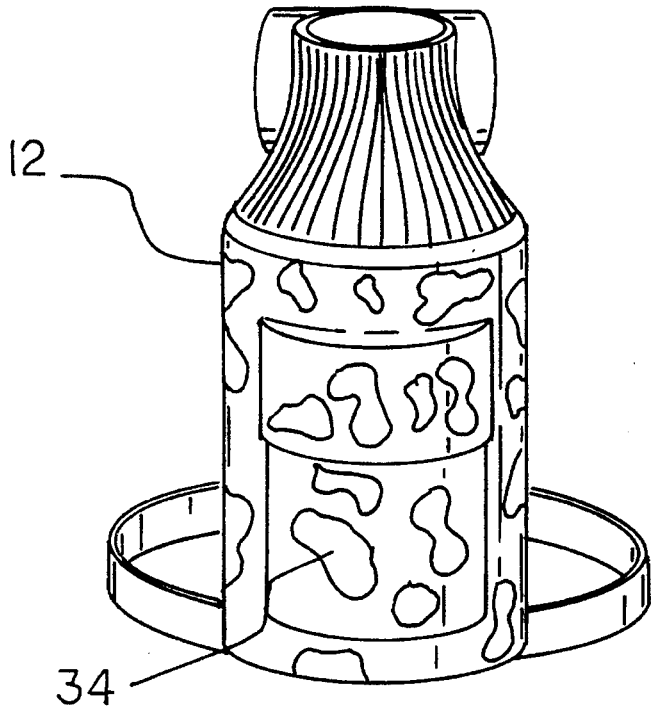
FIG. 2 is another perspective view of the present invention.
Figure 3:
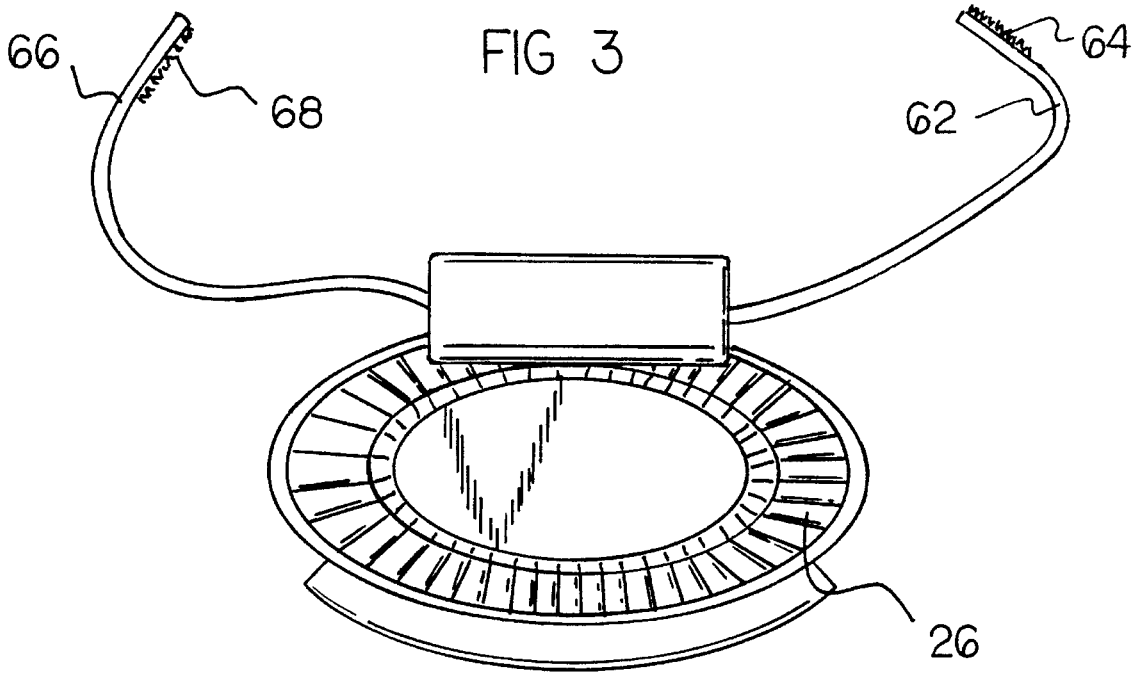
FIG. 3 is a plan view of the present invention with its leg strap in a decoupled configuration.
Figure 6:
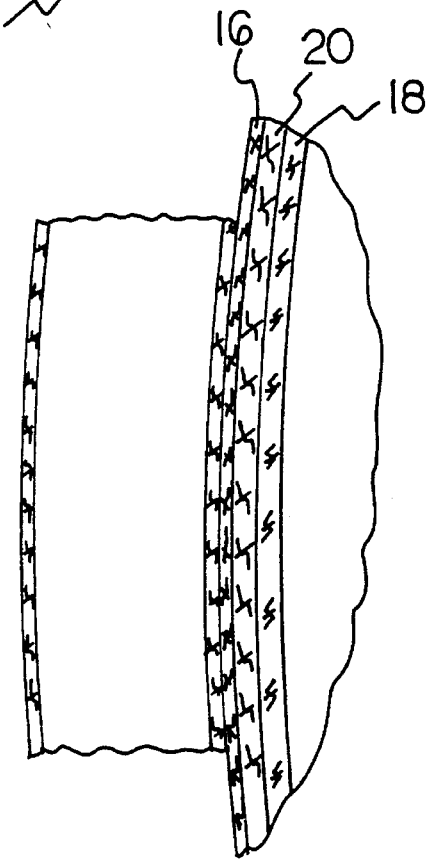
FIG. 6 is a cross-sectional view of the present invention taken along the line 6—6 of FIG. 5.

Specifically, the present invention includes a hip pocket 12 as shown in FIGS. 1 and 2. The hip pocket includes a tubular body 14. As best illustrated in FIG. 6, the body is formed of an outer waterproof camouflage-type fabric layer 16, an inner fleeced fabric layer 18, and an intermediate insulated fiber layer 20 disposed between the inner layer and outer layer. The body has a bottom end 22 sealed with an integral and generally planar circular flat wall. The body also has an open top end 24. In the preferred embodiment, the body has an axial length of about 10 inches and an exterior diameter of about 7½ inches. Thus, the axial length of the body is about 33% greater than its exterior diameter.

Figure 7:
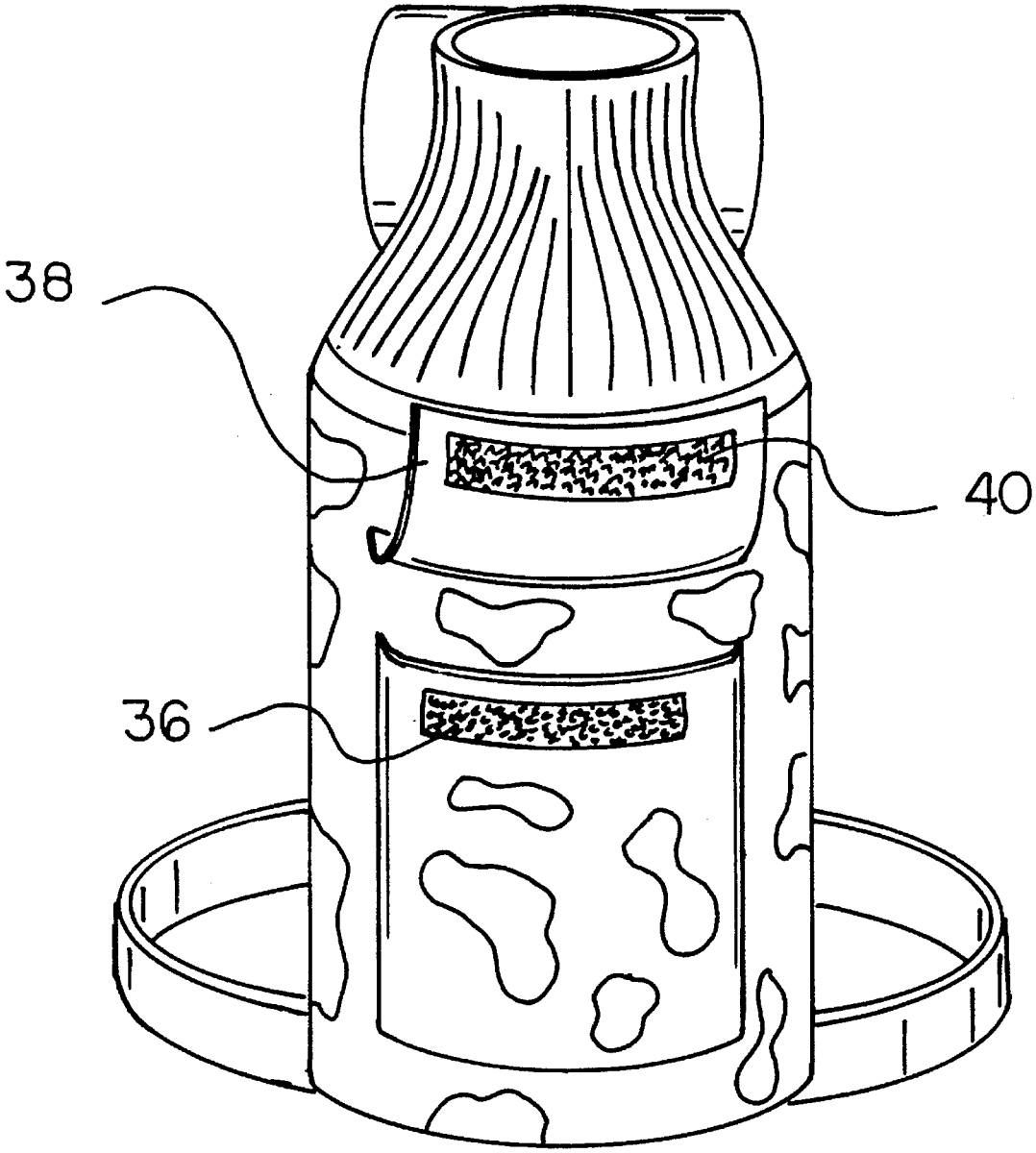
FIG. 7 is a view of the present invention with its exterior pocket opened.

The hip pocket also includes a cuff 26. The cuff is formed of an elastic ribbed fabric material. The cuff stretchable when extended yet returns to its original shape when released. The cuff is used for receiving a bow hunter's hand as shown in FIG. 1. The cuff has a conical hollow lower extent 28 sewn to the top end of the body and a tubular upper extent 30 extended upwards therefrom. The upper extent of the cuff is used for snugly fitting about the bow hunter's arm 32 once his hand is disposed within the body. The hip pocket also includes a generally rectangular exterior pocket 34 as shown in FIG. 2. The exterior pocket has an upwardly extending opening. The pocket is sewn to the outer layer 16 of the body and is used for holding hunting-related accessories therein. As best illustrated in FIG. 7, the exterior pocket has a strip of pile-type fastener 36 sewn thereto, a flap 38 sewn to the outer layer 16 of the body and positionable over the opening of the pocket, and a rectangular strip of complimentary pile-type fastener 40 sewn to the flap. The fastener 40 is removably securable with the fastener 36 to seal the opening upon discretion of the bow hunter.

Figure 4:
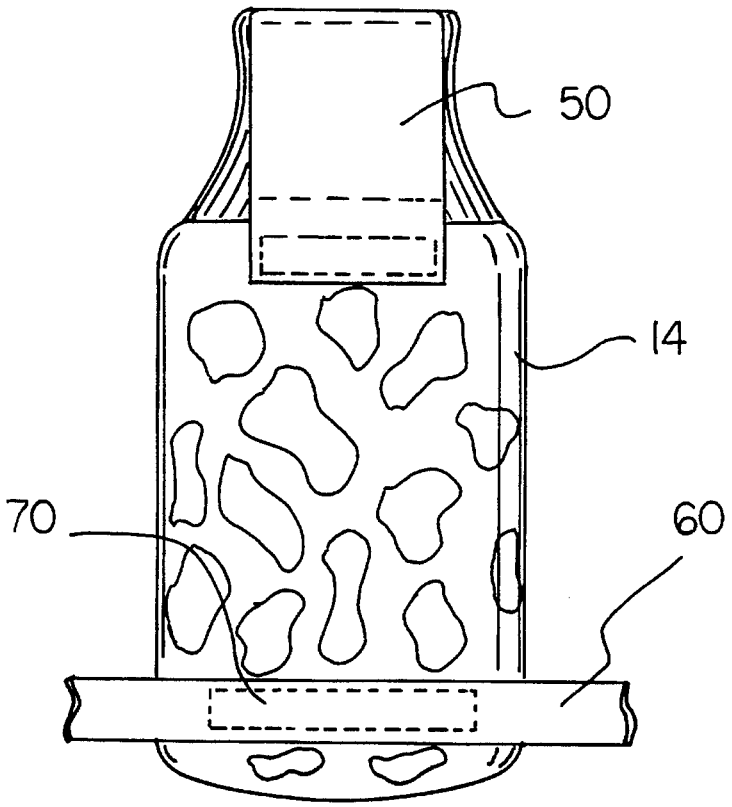
FIG. 4 is a side-elevational view of the present invention.
Figure 5:
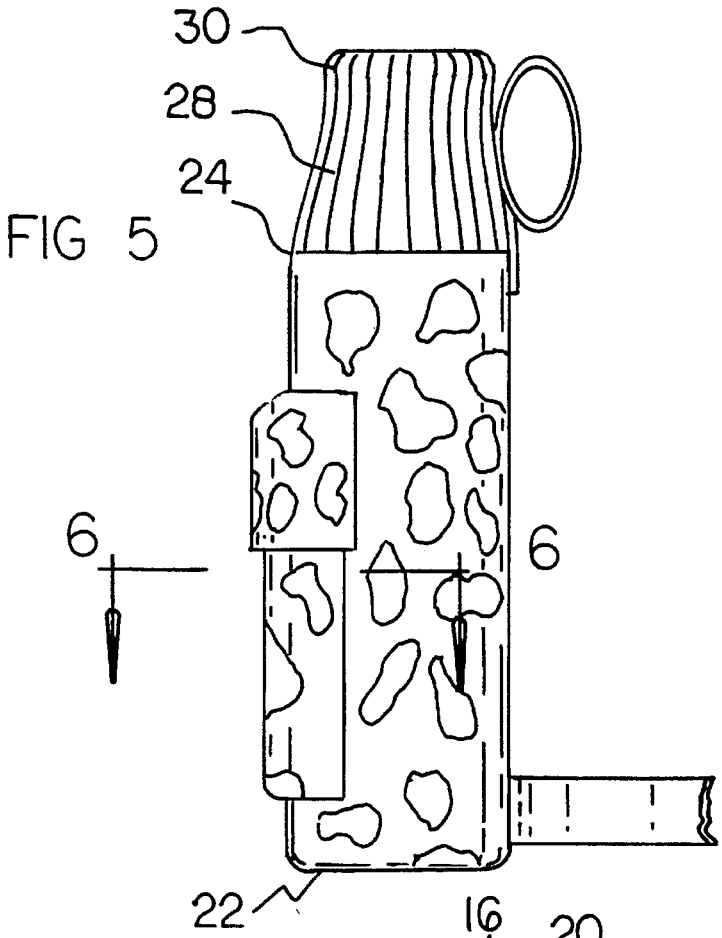
FIG. 5 is another side-elevational view of the present invention.

Also provided is a coupling mechanism for securing the hip pocket to a location on a bow hunter for ready access and use. The coupling mechanism includes a belt loop 50. The belt loop is formed of leather and sewn to the top end 24 of the body of the hip pocket as best illustrated in FIG. 4. The belt loop has a generally oval aperture sized for receiving a belt 52 of a bow hunter. In the preferred embodiment, the belt loop defines an aperture for receiving a belt with a width of up to about 3¾ inches. When the loop is secured to a belt of a hunter, the hip pocket may be carried at a location proximal with a bow hunter's waist as shown in FIG. 1.

The coupling mechanism also includes a leg strap 60. The leg strap is formed of a fabric material. The leg strap has a first free end 62 with a rectangular strip of pile-type fastener 64 sewn thereto. Furthermore, the leg strap has a second free end 66 with a complimentary rectangular strip of pile-type fastener 68 sewn thereto. An intermediate portion 70 between the ends of the strap is sewn to the body near the bottom end 22 thereof. The fasteners 64, 68 of the leg strap are removably securable in a closed loop configuration about a leg 72 of a bow hunter as shown in FIG. 1. When secured about a leg of a bow hunter, the leg strap thus prevents unmoderated movement of the hip pocket 12.

The present invention is a device which hangs off of a bow hunter's belt and is used as a hand warmer for bow hunting or any other cold weather sporting activity. The cuff of the present invention helps keep sticks, pine needles, and other debris from entering the body of the hip pocket. The leg strap holds the present invention in place and minimizes its movement when a bow hunter's hand is removed from the hip pocket or when the bow hunter is negotiating through heavy brush. The exterior pocket is sized for holding hunting-related accessories such as a finger tab, mechanical release, compass, map, or miscellaneous calling devices used for attracting game. In very cold weather conditions, a chemical activated hot pack is placed within the hip pocket to increase its warming capabilities. The outer fabric layer of the hip pocket can also bear a camouflage-type pattern. The inner layer of the hip pocket can be formed of a fleece material for providing extra warmth and an increased degree of quietness upon insertion or removal of a bow hunter's hand.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A hand warming muff and holding apparatus for allowing a bow hunter to keep his hand warm during hunting and for simultaneously carrying hunting-related accessories comprising, in combination:

a hip pocket including a tubular body formed of an outer fabric layer and an inner fabric layer with an intermediate insulated layer disposed therebetween, the body having a sealed bottom end, an open top end, and an axial length about 33% greater than its diameter, the hip pocket further including an elastic ribbed fabric cuff for receiving a bow hunter's hand, the cuff having a conical hollow lower extent coupled to the top end of the body and a tubular upper extent for snugly fitting about the bow hunter's arm once his hand is disposed within the body, the hip pocket additionally including a generally rectangular exterior pocket with an upwardly extended opening affixed to the outer layer of the body for holding hunting-related accessories therein, the exterior pocket having a strip of pile-type fastener coupled thereto, a flap affixed to the body and positionable over the opening, and a strip of complimentary pile-type fastener affixed to the flap and removably securable with the pile-type fastener to seal the opening;

a leather belt loop affixed to the top end of the body of the hip pocket, the belt loop sized for receiving a belt of a bow hunter and thus allowing the hip pocket to be carried at a location proximal with the bow hunter's waist; and a leg strap formed of a fabric material having a first free end with a pile-type fastener secured thereto, a second free end with a complimentary pile-type fastener secured thereto, and an intermediate portion between the ends affixed to the body near the bottom end thereof and with the fasteners of the leg strap removably securable in a closed loop configuration about a leg of a bow hunter to prevent unmoderated movement of the hip pocket.

2. A hand warming muff and holding apparatus for use by a bow hunter comprising:

a hip pocket including a tubular insulated body having a sealed bottom end and an open top end, a cuff coupled to the top end of the body for receiving a bow hunter's hand and snugly fitting about the bow hunter's arm once his hand is disposed within the body, and an exterior pocket affixed to the body for holding hunting-related accessories therein; and a coupling mechanism for removably securing the hip pocket for use at a location proximal with a bow hunter's waist.

3. The hand warming muff and holding apparatus as set forth in claim 2 wherein the body is formed of an outer fabric layer and an inner fabric layer an intermediate insulated fiber layer disposed therebetween.

4. The hand warming muff and holding apparatus as set forth in claim 2 wherein the body has an axial length about 33% greater than its diameter.

5. The hand warming muff and holding apparatus as set forth in claim 2 wherein the cuff is formed of an elastic ribbed fabric and has a conical hollow lower extent and a tubular upper extent.

6. The hand warming muff and holding apparatus as set forth in claim 2 further including a flap affixed to the body for selectively sealing the exterior pocket.

7. The hand warming muff and holding apparatus as set forth in claim 2 wherein the coupling mechanism includes a leather belt loop affixed to the hip pocket with the belt loop sized for receiving a belt of a bow hunter.

8. The hand warming muff and holding apparatus as set forth in claim 2 wherein the coupling mechanism includes a leg strap affixed to the hip pocket and securable in a closed loop configuration about a leg of the bow hunter.

* * * * *